United States Patent [19]

Waller, Jr.

[11] Patent Number: 5,055,075

[45] Date of Patent: Oct. 8, 1991

[54] DIRECTIONAL FINS FOR BODY AND BODY BOARD SURFING

[75] Inventor: Harold E. Waller, Jr., San Diego, Calif.

[73] Assignee: WXW, Inc., San Diego, Calif.

[21] Appl. No.: 542,770

[22] Filed: Jun. 25, 1990

[51] Int. Cl.[5] ..... A63B 31/12

[52] U.S. Cl. ..... 441/59; 441/60; 441/65

[58] Field of Search ..... 441/55, 56, 59, 60, 441/61, 65; D21/236, 238, 239

[56] References Cited

U.S. PATENT DOCUMENTS

| | | | |
|---|---|---|---|
| 613,610 | 11/1898 | Stroup . | |
| 1,130,209 | 3/1915 | Sommerfeld | 441/60 |
| 1,137,289 | 4/1915 | Royster . | |
| 1,252,619 | 1/1918 | Russo . | |
| 1,480,366 | 9/1923 | Bergerson . | |
| 1,827,308 | 10/1932 | Dorris . | |
| 2,786,526 | 1/1974 | Ausseil | 441/59 |
| 2,792,577 | 5/1957 | Boyers | 9/21 |
| 2,898,611 | 8/1959 | Mooney | 9/21 |
| 2,975,438 | 3/1961 | Magone | 441/59 |
| 3,015,829 | 1/1962 | Gronkowski | 441/60 |
| 3,078,482 | 2/1963 | Crowder | 441/60 |
| 3,109,186 | 11/1963 | Glenn | 9/309 |
| 3,286,287 | 11/1966 | Martin | 9/308 |
| 3,428,980 | 2/1969 | Newton | 441/55 |
| 4,756,699 | 7/1988 | Brom | 441/59 |
| 5,015,208 | 5/1991 | Fox et al. | 441/55 |

*Primary Examiner*—Sherman Basinger
*Assistant Examiner*—Stephen P. Avila
*Attorney, Agent, or Firm*—Brown, Martin, Haller & McClain

[57] ABSTRACT

A fin assembly for assisting a body or body board surfer in steering comprises a fin member of vane-like, generally planar shape and a securing device for securing the fin member to the limb of a surfer so that the fin projects generally downwardly into the water from the undersurface of the surfer's body. Preferably, oppositely directed right and left hand fin members are provided for securing to right and left hand limbs, respectively, of the surfer. The fin member has an enlarged base from which the fin projects, and the securing device is designed to secure the base against the appropriate limb so that the fin projects generally outwardly.

36 Claims, 2 Drawing Sheets

DIRECTIONAL FINS FOR BODY AND BODY BOARD SURFING

BACKGROUND OF THE INVENTION

1. Field of the Invention

The present invention relates generally to fins worn on the body of a person during aquatic activity, and is particularly concerned with fins for aiding a wearer in maneuvering during body or body board surfing.

2. Description of Related Art

A number of fin devices and appliances have been proposed in the past for aiding swimmers by increasing thrust when, swimming. These are generally in the form of fin members attached to the arms or legs and directed to exert greater thrust when the swimmer moves their arms and legs in specific motions while swimming. However, these devices are generally complex and uncomfortable, and would not be useful for body or body board surfing.

SUMMARY OF THE INVENTION

It is an object of this invention to provide a new and improved fin assembly for use in body or body board surfing.

According to the present invention, a fin assembly is provided for attachment to the body of a body or body board surfer to assist in maneuvering the surfer through the water. The assembly comprises at least one fin member of vane like shape having an elongate, stream-lined cross-section, a leading edge, a trailing edge, a base and a tip, and a securing device for securing the fin member at a predetermined location and orientation on the surfer's body with the leading edge facing generally in the direction of travel through the water and the tip of the fin projecting generally downwardly into the water from the undersurface of the surfer's body when surfing. The fin member therefore acts in the manner of a rudder on a boat assisting in making turns.

In the preferred embodiment of the invention a pair of fin members is provided, each being attached to a securing device to secure the respective fin member to a respective right or left limb of the surfer. The securing device preferably comprises a sleeve of resilient material for tight fitting engagement over the respective limb. Each fin member has an enlarged base for generally following the contour of a wearer's limb, and the base is retained within the sleeve which has an appropriately positioned slot through which the remainder of the fin projects. The sleeve is of predetermined diameter to substantially match that of the limb over which it is to be engaged, such as the calf region of the leg, the upper arm or the forearm. Preferably an adjustable tightening device is provided for securing the sleeve at least at one end.

Preferably, the leading edge of the fin toes in or out at a predetermined angle to the longitudinal axis of the limb to which it is to be secured, and thus to the direction of travel in the water, dependent on the location of the fin relative to the vertical axis of rotation of the surfer. If the fins are worn aft of the vertical axis of rotation of the surfer, as in the case of the shin fin, the leading edge of the fin toes in. If the fins are worn forward of the vertical axis of rotation of the surfer, as in the case of the upper arm fin or the forearm fin, the leading edge of the fin toes out. In other words, the central longitudinal axis of the fin between its leading and trailing ends is at a predetermined angle to that of the securing device. This angle, known as the "angle of attack", is between 0° and 25° with the leading edge of the fin directed inward at angles greater than 0° where it is designed to be attached to the wearer's leg, or directed outward at angles greater than 0° where it is designed to be attached to the wearer's arm. This will assist the wearer in making turns, since the surfer will lean his body in the direction to be turned, presenting a broad, outboard surface of the fin on the innermost leg or arm to oppose oncoming water flow and thus steer into the turn in the manner of a rudder or steering vane on an airplane. The leading edges of the right and left leg vanes or fins are both directed inward in the preferred embodiment of the invention. Preferably, one face of the fin is flat with the other face being cambered. The flat face is the face which opposes overcoming water flow, and is the outermost face in the case of fins positioned aft of the vertical axis of rotation, and the innermost face in the case of fins to be worn forward of this axis, e.g., on the upper arms or forearms. The impact of water on the flat face will assist the turn by tending to steer the limbs in the desired direction, while the curved surface provides lift in the same direction in an equivalent manner to an airplane wing.

The tip of the fin is preferably inclined outward at angles between 0° and 30° for increased stability in turning. Where fins are attached at the calves of both legs with the tips angled out from the vertical, and the surfer tilts or rotates their body into the turn,. the innermost side of the body will tend to turn downwards in the water. This means that the vane or fin on that side will become more vertical while the vane on the outermost leg becomes close to horizontal. Thus, the innermost vane becomes active for steering while the outermost vane becomes inactive but at the same time acts as a stabilizer.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT(S)

Figure 1:
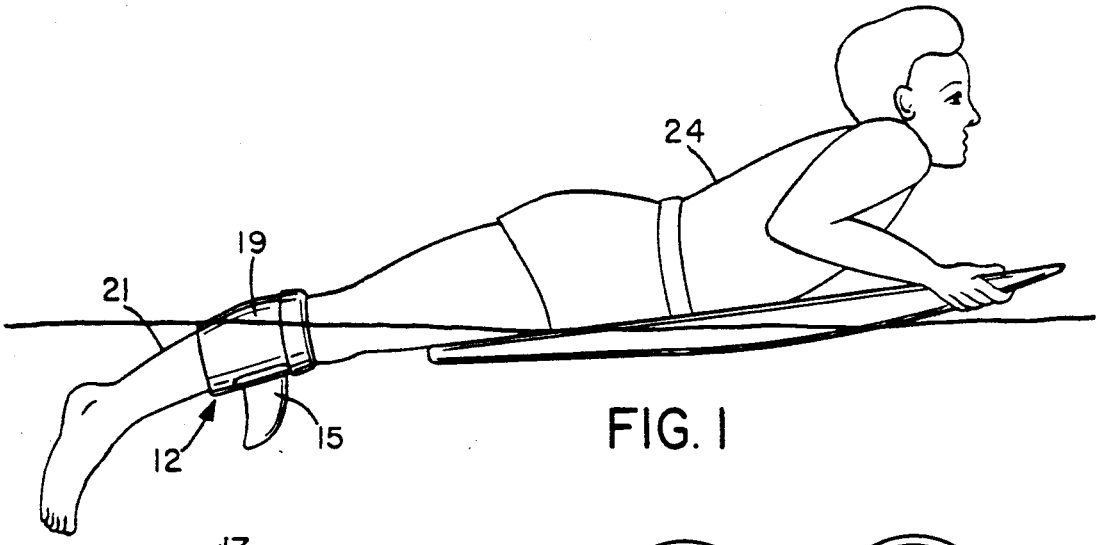
FIG. 1 is a side elevational view of a person body board surfing while wearing a directional fin assembly according to a first embodiment of the present invention.
Figure 2:
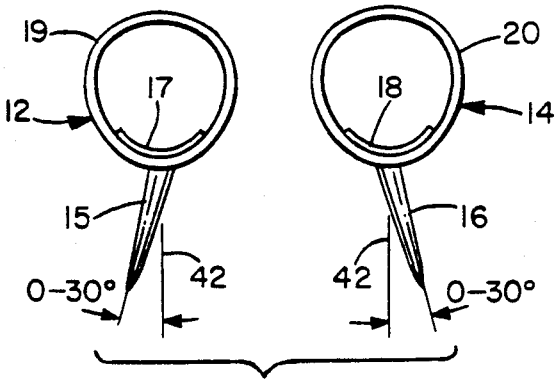
FIG. 2 is a front elevational view of a pair of left and right leg or shin fins, as seen from the front, as they would be oriented on the legs of a wearer in the normal straight steering position.
Figure 4:
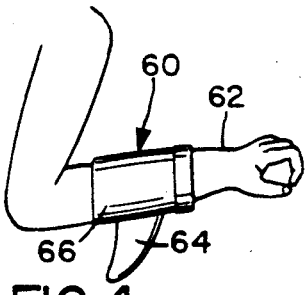
FIG. 4 is a side elevational view of an alternative fin for wearing on the forearm of a surfer while body board surfing.
Figure 3:
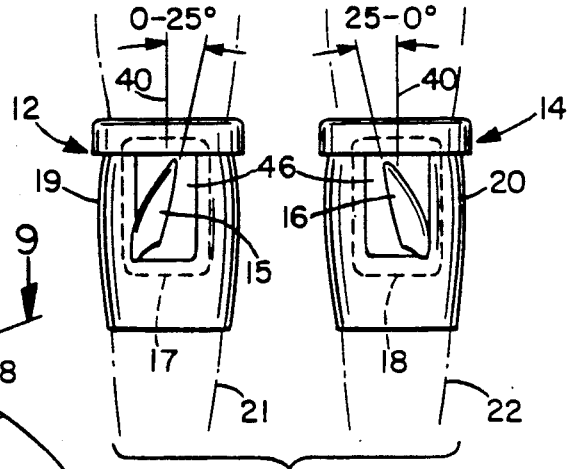
FIG. 3 is a view of the fins as they would appear when seen from beneath the body of the wearer in FIG. 2.
Figure 4A:
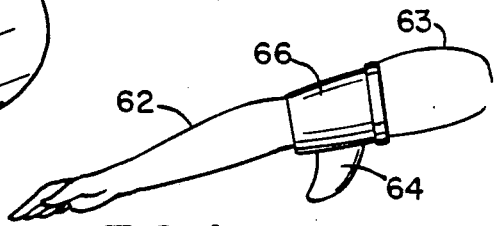
FIG. 4A is a side elevational view of an alternative fin for wearing on the upper arm of a surfer while body surfing.
Figure 6:
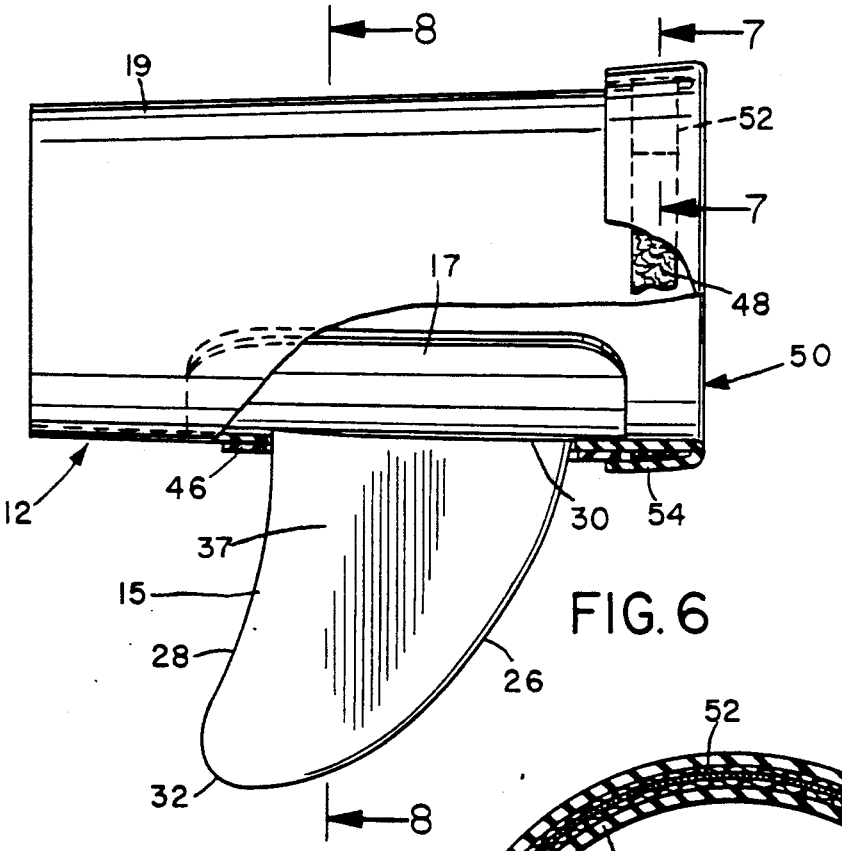
FIG. 6 is a side elevational view, partly cut away, of the fin member and securing sleeve.

FIGS. 1 to 3 of the drawings illustrate the use of a pair of directional fin assemblies 12, 14 according to the preferred embodiment of the invention. Each assembly basically comprises a fin member 15, 16 having a base 17, 18 mounted in respective securing sleeves 19, 20 for securing them to the right and left calf or shin regions 21, 22, respectively, of a surfer 24. Similar fins may additionally or alternatively be attached to the surfer's forearms and upper arms as generally illustrated in FIG. 4 and FIG. 4A, or to other body locations such as the hands. The structure of the fins and their securing or mounting sleeves is illustrated in more detail in FIGS. 5 to 9.

Figure 5:
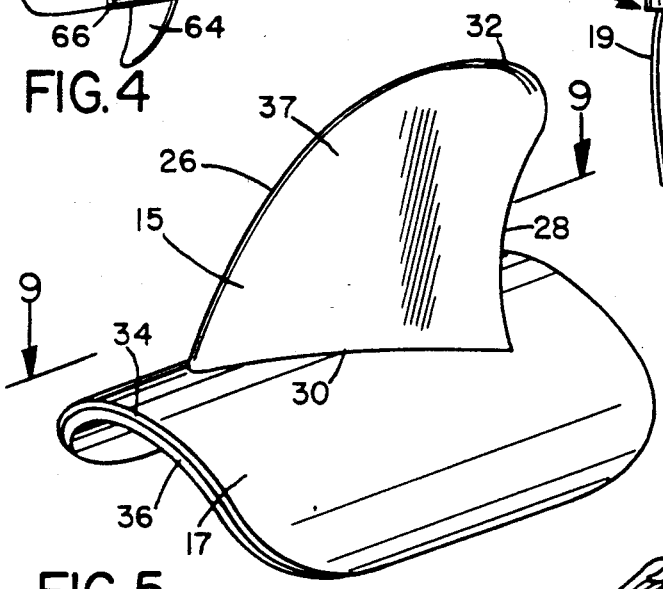
FIG. 5 is an enlarged perspective view of one of the right hand leg or shin fin members of the assembly of FIGS. 1 to 3.

Each fin member 15, 16 comprises a fin of generally vane-like shape having a leading edge 26, a trailing edge 28, a lower end 30 secured to the respective base 17, 18, and a tip 32. FIG. 5 illustrates a right hand shin fin 15 in more detail. The left hand shin fin 16 is of similar construction but the fin is inclined in the opposite direction, as can be seen in FIG. 3. Each fin member is secured at its lower end to the respective base member which is of curved or arcuate cross-section and generally rectangular or circular outline. Each base member 17, 18 is preferably formed of the same material as the fin itself and may have an inner, cushioning layer 36 of foam or rubber material, of the type generally used in wetsuit construction. The fin member itself is preferably of a flexible material such as molded plastic or fiberglass laminate with a modulus of elasticity ranging from $10^3$ to $6.2\times10^6$ p.s.i.

Figure 9:
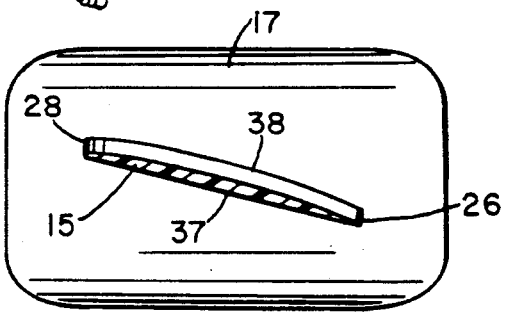
FIG. 9 is a cross-section on the lines 9—9 of FIG. 5.
Figure 8:
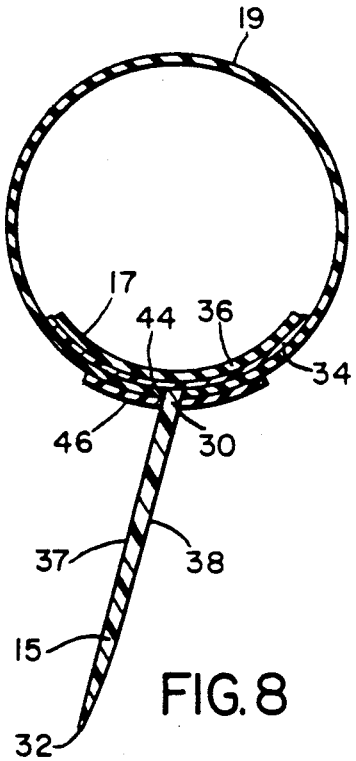
FIG. 8 is a cross-section on the lines 8—8 of FIG. 6.

The fins 15, 16 have a curved or convex leading edge 26 and concave trailing edge and form an airfoil-like shape, and are of streamlined horizontal cross-section, as seen in FIGS. 2 and 9, with a tapered leading edge and a flat trailing edge. Additionally, the outer face 38 of each fin is preferably flat while the inner face 37 is preferably curved or cambered, as best seen in FIGS. 5, 8 and 9, for added lift, as will be explained below. The fin is preferably secured to the base member so that the lower edge 30 of the fin (see FIG. 3) is inclined at a predetermined angle relative to the central longitudinal axis 40 of the base member, as can be seen in FIGS. 3 and 5. The angle of inclination is such that the leading edge 26 of the fin will toe in with respect to the direction of travel in the water when the fin device is secured to the wearer's leg. In the preferred embodiment illustrated the angle of inclination, or angle of attack relative to the water flow direction over the fin, is about 15°. However, angles ranging from 0° to 25° may be used. The left hand fin will be directed on its base member in the opposite direction from the right hand fin illustrated in FIG. 5, so that both fins toe inward and present their outer faces 38 to the oncoming water.

Additionally, each fin member is preferably tilted outwardly at its tip 32 relative to its lower end 30 on the base member 17, 18, as best illustrated in FIGS. 2 and 8. In other words, the fin is canted outwardly from the vertical or perpendicular direction 42 relative to the base member at an angle between 0° and 30°. Both shin fin members, therefore, toe in at their leading ends relative to the leading end of the base member, and are canted or tilted outwardly from their base to their tip, in the preferred embodiment of the invention.

Figure 7:
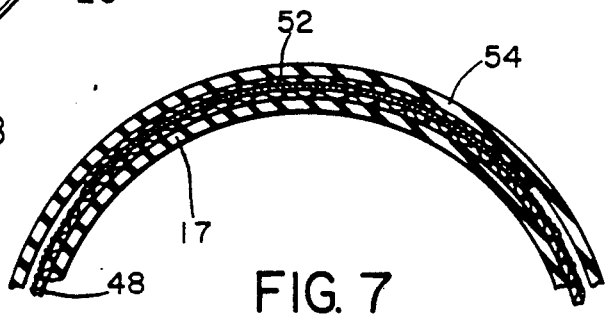
FIG. 7 is an enlarged cross-section on the lines 7—7 of FIG. 6.

Each fin member is mounted with its base member 17, 18 on the inside of generally cylindrical sleeve 19, 20 and its fin projecting outwardly through a suitable correspondingly inclined slit 44 in the sleeve. An extra, reinforcing layer 46 may be secured to the outer surface of the sleeve surrounding the slit, as illustrated in FIGS. 3 and 8. The sleeve itself is of flexible, elasticated material such as Neoprene® (registered trademark) or other materials of the type used in diving or other swimwear, and is suitably dimensioned so that it can be pulled onto the calf over the feet and ankles of the wearer relatively easily. In this embodiment, the base of the fin is designed to be located against the surfer's skin so that the fin faces generally downwardly. A tightening strap or band 48 extends around the forward end 50 of the sleeve to secure it in place over the upper end of the wearer's calf, so that the sleeve will be unlikely to slip down during surfing. The strap 48 is preferably of hook and loop-type, non-elastic fastener material such as Velcro® (registered trademark). A fastener strip 52 of mating hook and loop-type material is fastened over the ends of the strap to secure it in place once it has been pulled to the desired tightness, as best illustrated in FIG. 7. The strap may be completely separate from the sleeve or secured to it along part of its length. After fastening the strap, the forward end of the sleeve is folded back over the strap to form a collar 54.

FIGS. 4 and 4A illustrate modified fin assembly 60 of similar construction designed for securing to the forearm 62 or upper arm 63 of a surfer. As in the first embodiment, the fin assembly comprises a fin member 64 secured via its base (not visible in the drawings) to a suitable sleeve 66 for fitting over the surfer's forearm or upper arm. Oppositely directed fins will be provided for securing to the right and left forearm or upper arm. The arm fins will be worn on the lower arm if body board surfing and on the upper arm for body surfing, in the general positions illustrated in FIGS. 4 and 4A. As in the first embodiment, the overall shape of the fins in FIGS. 4 and 4A are the same as for the previous embodiment. The orientation of the upper body fins is distinct from the orientation of the lower body fins. In the case of upper body fins, the fins toe outward, incline outward and have the cambered side of each fin on the outside and the flat side of the fin on the inside. In general, fins worn to the rear of the vertical axis of rotation of the surfer's body, e.g., shin fins, toe in and have their flat faces on the outside, while fins worn forward of this axis toe out with their flat faces on the inside.

Operation of the shin fins illustrated in FIGS. 1 to 3 and 6 to 9 will now be described in more detail. In order to understand the operation of these fins, the normal body movements of a surfer must first be understood. FIGS. 1 to 3 illustrate the surfer, and attached fin assemblies, as they will be positioned in normal straight line surfing. In this position, the fins will tend to aid the surfer in steering straight because of the natural straightening or self-centering effect of the opposing, toed in left and right hand fins.

When the surfer wishes to make a turn, to the right for instance, they will naturally lean into the turn, turning their body in the direction they wish to go, at the same time rotating their body about its longitudinal axis so that the innermost side of the body with respect to the turn tends to roll downwards. This means, for the embodiment illustrated in the drawings, that the innermost or right hand side shin fin will be turned so that its flat outer face is directed against the oncoming water flow, which acts against this face so as to assist the turn in the manner of the rudder on a boat, i.e., it will act on the face 38 of fin 15 so as to urge it in a clockwise or right hand direction, assisting the surfer in steering in the desired direction. Additional lift will be provided by the cambered inner surface of the fin. At the same time, the innermost or right hand fin 15 will also be tilted or rotated from the position in FIG. 2 towards the vertical, while the outermost or left hand fin 16 will be rotated in the same direction as the body rolls, until it is more or less horizontal. Thus, the left hand fin will have little or no effect on the steering. The arm fins 60, if worn, will have a similar effect, with the right hand arm fin having its innermost flat face opposing oncoming water flow on rotation, and assisting the turn. In each case, it is the flat face which opposes oncoming water flow on making the turn.

With experience, the surfer will intuitively gain a "feel" of how to use the fins to control turns. The surfer may, for example, completely lift the outermost fin or fins out of the water to produce a faster turn. The fin assembly will therefore be able to significantly assist a body or body board surfer in making normal or acrobatic turns, by helping to steer the body in the desired direction.

The body board surfer may use the forearm fins of FIG. 4 in addition to the shin fins illustrated in the other drawings. The forearms are positioned alongside the body board when body board surfing, as illustrated in FIG. 1. Thus, fins positioned as in FIG. 4 will trail into the water. As with the leg or shin fins, when the surfer leans into the turn, the outermost fin lifts out of the water while the innermost fin becomes active for steering in an equivalent manner to the shin fin as explained above in connection with FIGS. 1 to 3. The forearm fins will toe outward at their leading ends when the body of the surfer is positioned as illustrated in FIG. 1, centering the body when travelling straight, and helping to steer into turns. Similar fin assemblies may also be provided for the hands, and upper arm fin assemblies similar to forearm fins may be used for body surfing as illustrated in FIG. 4A, with the arms in a streamlined position extending to the rear so that the upper arm fins trail in the water to center the body when travelling straight and to assist in making turns.

Figure 10:
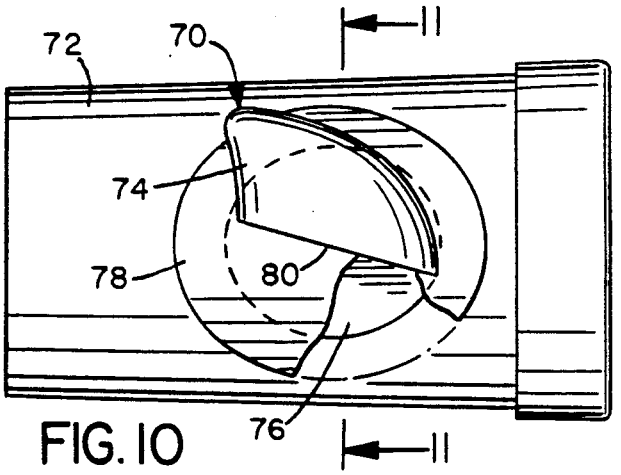
FIG. 10 is a bottom plan view, partially cut away, showing an alternative attachment of a fin to a sleeve according to a second embodiment of the invention.
Figure 11:
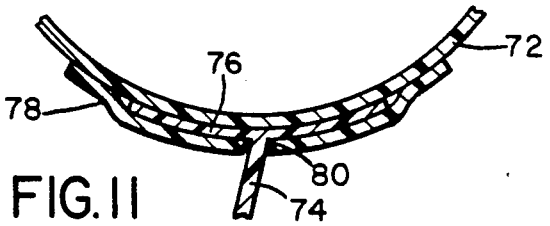
FIG. 11 is an enlarged sectional view taken on line 11—11 of FIG. 10.

FIGS. 10 and 11 illustrate a second embodiment of the invention in which fin member 70 is attached to sleeve 72 in a different way. In this embodiment, the fin member 70 is of pliable plastic material and comprises a fin 74 of similar shape to that of the first embodiment, the fin 74 being secured at its lower end to a flat, circular base 76. The securing sleeve 72 has a circular reinforcing patch 78 of larger diameter than base 76 secured to its outer surface by adhesive or stitching extending around the periphery only of the patch 78, leaving a pocket between the central, unattached area of the patch 78 and the underlying sleeve surface. A slit 80 is formed in the patch at the appropriate angle to the longitudinal axis of the sleeve to define the "angle of attack" of the fin 74 as in the previous embodiment.

The base 76 of the fin member can be inserted through the slit 80 into the pocket between the unattached, central area of the reinforcing patch 78 and the underlying surface of the sleeve 72, as best illustrated in FIG. 11, with the fin 74 projecting outwardly through the slit 80. The base may be glued in place, although this is not essential. This will be generally more comfortable than the sleeve in the previous embodiment, since the sleeve itself is continuous and uninterrupted on its inner surface. The pliable plastic material forming the base 76 enables it to conform to the curvature of the underlying limb. Alternatively, the base may be of a more rigid material having an arcuate cross section to follow the curvature of the limb, as in the first embodiment.

Apart from the different base and attachment means as described above, the fin member and securing sleeve of the second embodiment are otherwise the same as in the previous embodiment, and equivalent reference numerals have been used where appropriate. The left and right hand securing sleeves for shin fins will each have slits which are inclined inwardly towards the forward end of the sleeve when the sleeve is appropriately positioned on the legs of a surfer, so that the fins will be oriented substantially as illustrated in FIG. 3 of the first embodiment. As in the first embodiment, the fins are also tilted outwardly relative to the base, as can be seen in FIG. 11, and the fins have cambered inner faces and flat outer faces. The left and right hand securing sleeves for forearm or upper arm fins will toe outwardly towards their forward ends, to orient the arm fins in the same manner as described above in connection with FIGS. 4 and 4A. Thus, the operation of the fin assembly in this embodiment will be equivalent to that described above in connection with FIGS. 1 to 9.

The steering fins can be quickly and easily attached to the appropriate limb of the surfer using the easy, slide-on sleeve, and once attached will be unlikely to slip off or move from the desired position. With practice, the fins can make normal turns in body or body board surfing significantly easier and faster to accomplish.

Although a preferred embodiment of the invention has been described above by way of example only, it will be understood by those skilled in the field that modifications may be made to the disclosed embodiment without departing from the scope of the invention, which is defined by the appended claims.

I claim:

1. A fin assembly for securing to the lower part of a limb of a body or body board surfer for aiding in steering the body through turns, comprising:

a fin member having an elongate, stream-lined cross section, a leading edge, a trailing edge, a base and a tip; and securing means for releasably securing the fin member at a predetermined location and fixed orientation to a limb of a surferat a location remote from any limb joint with the leading edge facing generally in the direction of travel through the water, the securing means including positioning means for directing the fin member with its tip projecting generally downwardly into the water from the undersurface of the surfer's body when positioned for surfing.

2. The fin assembly as claimed in claim 1, wherein the base of said fin member comprises an enlarged, generally planar base member with a vane-like fin projecting transversely away from said base member.

3. A fin assembly for securing to the body of a body or body board surfer for aiding in steering the body through turns, comprising:

a fin member having a elongate, stream-lined cross-section, a leading edge, a trailing edge, a base and a tip;

the base of said fin member comprising an enlarged, generally planar base member with a vane-like fin projecting transversely away from said base member;

securing means for releasably securing the fin member at a predetermined location and orientation on a surfer's body with the leading edge facing generally in the direction of travel through the water, the securing means including positioning means for directing the fin member with its tip projecting generally downwardly into the water from the undersurface of the surfer's body when positioned for surfing; and said securing means comprising a generally cylindrical sleeve of elasticated material for slidable engagement over a body portion of a surfer, the sleeve having a slit of length substantially equal to the length of the fin member, and comprising means for holding said base member being located within the sleeve with the fin projecting out of the sleeve through said slit.

4. A fin assembly for securing to the body of a body or body board surfer for aiding in steering the body through turns, comprising:

a fin member having elongate, stream-lined cross-section, a leading edge, a trailing edge, a base and a tip;

the base of said fin member comprising an enlarged, generally planar base member with a vane-line fin projecting transversely away from said base member;

securing means for releasably securing the fin member at a predetermined location and orientation on a surfer's body with the leading edge facing generally in the direction of travel through the water, the securing means including positioning means for directing the fin member with its tip projecting generally downwardly into the water from the undersurface of the surfer's body when positioned for surfing; and the securing means comprising a generally cylindrical sleeve of elasticated material for slidable engagement over a body portion of a surfer, the sleeve having a reinforcing patch of corresponding shape to said base member secured around its outer periphery to the outer surface of the sleeve to form a pocket for receiving said base member, said patch having a slit of length at least equal to the length of the fin member for allowing said fin member to project out of said pocket via said belt.

5. The fin assembly as claimed in claim 4, wherein said slit is inclined relative to the longitudinal axis of said sleeve.

6. The fin assembly as claimed in claim 1, wherein there are two said fin members, one fin member comprising a left hand fin and the other comprising a right hand fin, and said securing means comprising means for securing said left and right hand fins, respectively, to a right and left limb, respectively, of a surfer.

7. A fin assembly for securing to the legs of a body or body board surfer for aiding in steering the body through turns, comprising:

a pair of fin members each having an elongate, stream-lined cross-section, a leading edge, a trailing edge, a base and a tip, one fin member comprising a left hand fin and the other comprising a right hand fin;

securing means for releasably securing said left and right hand fin members, respectively, to the left and right legs, respectively, of a surfer at a predetermined location and orientation, with the leading edge of each fin member facing generally in the direction of travel through the water, the securing means including positioning means for directing the fin members with their tips projecting generally downwardly into the water from the undersurface of the surfer's body when positioned for surfing; and said fins being directed inwardly relative to the direction of travel in the water when secured to the respective legs of a surfer.

8. The fin assembly as claimed in claim 6, wherein said securing means comprises means for securing said fin members to respective left and right arms with said arm fins directed outwardly relative to the direction of travel in the water when secured to the respective arms of a surfer.

9. The fin assembly as claimed in claim 6, wherein each securing means has a longitudinal axis for alignment with the axis of the respective limb of a surfer, and each fin member has a longitudinal axis inclined at an angle of attack between 0° and 25° to said longitudinal axis of its associated securing means.

10. The fin assembly as claimed in claim 9, wherein the securing means comprises means for securing said fins to the legs of a surfer, the leading edge of the left leg fin being inclined to the right at a predetermined angle of attack greater than 0°, and the leading edge of the right leg fin being inclined to the left at the same angle of attack as the left leg fin.

11. The fin assembly as claimed in claim 6, wherein each fin member comprises a generally planar base member and a vane-like fin projecting transversely away from the base member.

12. The fin assembly as claimed in claim 11, wherein the fin is canted at an angle between 0° and 30° to a plane extending perpendicular to the base member.

13. The fin assembly as claimed in claim 12, wherein the right and left hand fins are canted outwardly in opposite directions relative to their respective base members so that when they are secured to the respective right and left limbs of a surfer, they will tilt outwardly at their tips away from one another.

14. The fin assembly as claimed in claim 7, wherein the innermost face of each leg fin is cambered and the outermost face is flat.

15. The fin assembly as claimed in claim 8, wherein the innermost face of each arm fin is flat and the outermost face is cambered.

16. The fin assembly as claimed in claim 8, wherein the leading edge of the left arm fin is inclined to the left at a predetermined angle of attack greater than 0°, and the leading edge of the right arm fin is inclined to the right at the same angle of attack as the left arm fin.

17. The fin assembly as claimed in claim 1, wherein the fin member is of streamlined horizontal cross-section having a tapered leading edge and a flat trailing edge.

18. The fin assembly as claimed in claim 1, wherein the fin member has a leading edge and a trailing edge, the leading edge being of generally convex shape along its length and the trailing edge being of generally concave shape along its length.

19. The fin assembly as claimed in claim 1, wherein the fin member is of a material having a modulus of elasticity in the range from $10^3$ to $6.2 \times 10^6$ p.s.i.

20. The fin assembly as claimed in claim 1, wherein the fin member is of a flexible plastic material.

21. A fin assembly for assisting steering when body or body board surfing, comprising:

a vane-like fin having a leading edge, a trailing edge, a lower edge and a tip;

an enlarged base member rigidly secured to the lower edge of the fin so that the fin projects transversely from the base member; and securing means for releasably securing the fin to a limb of a surfer, the securing means comprising a generally cylindrical sleeve member of elasticated material for close engagement over a generally cylindrical limb portion of a surfer, said sleeve including retaining means for retaining said base member, the retaining means including a slot comprising means for allowing the fin to project transversely outwardly from the sleeve in a fixed orientation relative to the limb portion to which it is secured.

22. The assembly as claimed in claim 21, wherein the base is of predetermined arcuate cross section for generally matching the contour of the body surface against which it is to be secured.

23. The assembly as claimed in claim 21, wherein the base includes an outer layer and an inner layer secured to the outer layer, the inner layer being of softer material than the outer layer.

24. The assembly as claimed in claim 21, wherein the fin and base each have a leading end and a trailing end and the fin extends in the same general direction as the base.

25. A fin assembly for assisting steering when body or body board surfing, comprising:

a fin member having a generally planar base and a vane-like fin projecting transversely from the base;

securing means for releasably securing the fin member to a pre-selected body location on a surfer, the securing means comprising a generally cylindrical sleeve member of elasticated material for close engagement over a generally cylindrical body portion of a surfer, said sleeve including retaining means for retaining said base of the fin member, the retaining means including a slot comprising means for allowing the fin to project transversely outwardly from the sleeve, and the longitudinal axis of the fin being at an angle of between 0° and 25° to the longitudinal axis of the base.

26. The assembly as claimed in claim 21, wherein the fin is canted at a non-perpendicular angle relative to the plane of the base.

27. The assembly as claimed in claim 26, wherein the fin is canted at an angle between 0° and 30° to the perpendicular.

28. The assembly as claimed in claim 21, wherein there are two said fin members and securing sleeves, one fin member comprising a left fin and the associated sleeve comprising means for securing said fin to a left limb of a surfer and the other fin member comprising a right fin and the associated sleeve comprising means for securing said right fin to a right limb of a surfer.

29. The assembly as claimed in claim 28, wherein said fin members and sleeves are of predetermined dimensions for fitting over the right and left shins of a surfer.

30. The assembly as claimed in claim 28, wherein said fin members and sleeves are of predetermined dimensions for fitting over the right and left forearms or upper arms of a surfer.

31. The assembly as claimed in claim 28, wherein said retaining means on each sleeve comprises a reinforcing patch of corresponding shape to said base and of larger dimensions than said base, the reinforcing patch being secured around its outer periphery to the outer surface of said sleeve to leave a pocket for receiving said base between the patch and underlying surface of said sleeve, said slot being provided in said patch in each sleeve.

32. The assembly as claimed in claim 31, wherein each slot is inclined relative to the longitudinal axis of the respective sleeve.

33. The assembly as claimed in claim 31, including leg and arm fin members and associated securing sleeves for securing said leg and arm fin members to respective legs and arms of a surfer.

34. The assembly as claimed in claim 33, where each slot is inclined relative to the longitudinal axis of the respective sleeve, the slots being inclined inwardly towards the forward end of the respective left and right hand sleeves for securing said leg fin members to the respective left and right legs of a surfer, and the slots being inclined outwardly towards the forward end of the respective left and right hand sleeves for securing said arms fins to the respective left and right arms of a surfer.

35. The assembly as claimed in claim 21, including tightener means for tightening at least one end of said sleeve around said body portion, said tightener means comprising a band for extending around the outside of said sleeve adjacent one end and fastener means for releasably securing the tightened band in place.

36. A method of body or body board surfing, comprising the steps of:

securing left and right hand fin members at predetermined locations separately to the left and right hand limbs, respectively, of a surfer so that the fins project downwardly into the water in a fixed, substantially rigid orientation relative to the respective limb when the surfer is in a standard, straight line surfing position, each fin member comprising a vane-like fin having a leading edge facing generally in the direction of travel through the water when secured to the respective limb; and using the fins when surfing to aid in steering the body through the water by rotating the respective limbs.

* * * * *

UNITED STATES PATENT AND TRADEMARK OFFICE

CERTIFICATE OF CORRECTION

PATENT NO. : 5,055,075

DATED : October 8, 1991

INVENTOR(S) : Harold E. Waller, Jr.

It is certified that error appears in the above-identified patent and that said Letters Patent is hereby corrected as shown below:

Column 6, Line 54, "surferat" should read --surfer at--

Column 7, Line 53, "belt" should read --slit--

Signed and Sealed this

Ninth Day of March, 1993

*Attest:*

STEPHEN G. KUNIN

*Attesting Officer*

*Acting Commissioner of Patents and Trademarks*